US009194238B2

(12) United States Patent
Roberts, III et al.

(10) Patent No.: US 9,194,238 B2
(45) Date of Patent: Nov. 24, 2015

(54) SYSTEM FOR DAMPING VIBRATIONS IN A TURBINE

(71) Applicant: General Electric Company, Schenectady, NY (US)

(72) Inventors: Herbert Chidsey Roberts, III, Simpsonville, SC (US); Curtis Alan Johnson, Niskayuna, NY (US); Glenn Curtis Taxacher, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 475 days.

(21) Appl. No.: 13/687,027

(22) Filed: Nov. 28, 2012

(65) Prior Publication Data

US 2014/0147276 A1 May 29, 2014

(51) Int. Cl.

| | |
|---|---|
| ***F01D 5/22*** | (2006.01) |
| ***F01D 5/28*** | (2006.01) |
| ***F01D 11/00*** | (2006.01) |
| *F01D 5/30* | (2006.01) |

(52) U.S. Cl.

CPC *F01D 5/22* (2013.01); *F01D 5/284* (2013.01); *F01D 5/3084* (2013.01); *F01D 11/008* (2013.01); *F01D 5/3007* (2013.01); *F05D 2250/11* (2013.01); *F05D 2250/132* (2013.01); *F05D 2250/241* (2013.01); *F05D 2260/96* (2013.01); *F05D 2300/20* (2013.01); *F05D 2300/2112* (2013.01); *F05D 2300/2114* (2013.01); *F05D 2300/2118* (2013.01); *F05D 2300/2261* (2013.01); *F05D 2300/2283* (2013.01); *F05D 2300/6033* (2013.01)

(58) Field of Classification Search

CPC ..... F01D 5/22; F01D 5/284; F01D 5/3007; F01D 5/3084; F01D 11/008; F05D 2300/2283; F05D 2250/11; F05D 2260/96; F05D 2300/6033; F05D 2250/241; F05D 2300/2118

See application file for complete search history.

(56) References Cited

U.S. PATENT DOCUMENTS

| | | | | |
|---|---|---|---|---|
| 2,310,412 | A * | 2/1943 | Fianders | 416/190 |
| 2,686,655 | A * | 8/1954 | Schorner | 416/214 R |
| 2,862,686 | A * | 12/1958 | Bartlett | 416/233 |
| 3,784,320 | A * | 1/1974 | Rossmann et al. | 416/215 |
| 3,897,171 | A * | 7/1975 | Stahl | 416/244 R |
| 4,111,603 | A * | 9/1978 | Stahl | 416/95 |
| 4,917,574 | A | 4/1990 | Dodd et al. | |
| 5,156,528 | A * | 10/1992 | Bobo | 416/190 |
| 5,904,972 | A | 5/1999 | Tunis, III et al. | |
| 5,997,077 | A | 12/1999 | Siebels et al. | |
| 6,354,803 | B1 | 3/2002 | Grover et al. | |
| 6,494,679 | B1 * | 12/2002 | Gadre et al. | 416/145 |
| 7,067,007 | B2 | 6/2006 | Ackermann et al. | |
| 7,284,958 | B2 | 10/2007 | Dundas et al. | |
| 7,731,482 | B2 | 6/2010 | Lagrange et al. | |
| 7,757,808 | B1 | 7/2010 | Vaz et al. | |
| 7,874,804 | B1 | 1/2011 | Brown | |

(Continued)

*Primary Examiner* — Igor Kershteyn

(74) *Attorney, Agent, or Firm* — Dority & Manning, PA

(57) ABSTRACT

A system for damping vibrations in a turbine includes a first rotating blade having a first ceramic airfoil, a first ceramic platform connected to the first ceramic airfoil, and a first root connected to the first ceramic platform. A second rotating blade adjacent to the first rotating blade includes a second ceramic airfoil, a second ceramic platform connected to the second ceramic airfoil, and a second root connected to the second ceramic platform. A non-metallic platform damper has a first position in simultaneous contact with the first and second ceramic platforms.

20 Claims, 8 Drawing Sheets

(56) References Cited

U.S. PATENT DOCUMENTS

| | | | |
|---|---|---|---|
| 7,972,113 | B1 | 7/2011 | Davies |
| 8,162,617 | B1 | 4/2012 | Davies et al. |
| 2005/0118369 | A1 | 6/2005 | Kennedy |
| 2005/0158171 | A1 | 7/2005 | Carper et al. |
| 2007/0085251 | A1 | 4/2007 | Kikuchi et al. |
| 2007/0281810 | A1 | 12/2007 | Garcia |
| 2008/0047679 | A1 | 2/2008 | Frasier et al. |
| 2009/0241549 | A1 | 10/2009 | Clay et al. |
| 2010/0143097 | A1 | 6/2010 | Read et al. |
| 2010/0189556 | A1 | 7/2010 | Propheter-Hinckley et al. |
| 2011/0229337 | A1 | 9/2011 | Carper et al. |
| 2011/0253031 | A1 | 10/2011 | Shonai |
| 2012/0163978 | A1 | 6/2012 | Darkins, Jr. et al. |
| 2012/0275920 | A1* | 11/2012 | Delvaux et al. ..... 416/204 R |

* cited by examiner

SYSTEM FOR DAMPING VIBRATIONS IN A TURBINE

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present disclosure generally involves a system for damping vibrations in a turbine. In particular embodiments, the system may be used to damp vibrations in adjacent rotating blades made from ceramic matrix composite (CMC) materials.

BACKGROUND OF THE INVENTION

Turbines are widely used in a variety of aviation, industrial, and power generation applications to perform work. Each turbine generally includes alternating stages of peripherally mounted stator vanes and rotating blades. The stator vanes may be attached to a stationary component such as a casing that surrounds the turbine, and the rotating blades may be attached to a rotor located along an axial centerline of the turbine. A compressed working fluid, such as steam, combustion gases, or air, flows along a hot gas path through the turbine to produce work. The stator vanes accelerate and direct the compressed working fluid onto the subsequent stage of rotating blades to impart motion to the rotating blades, thus turning the rotor and performing work.

Each rotating blade generally includes an airfoil connected to a platform that defines at least a portion of the hot gas path. The platform in turn connects to a root that may slide into a slot in the rotor to hold the rotating blade in place. Alternately, the root may slide into an adaptor which in turn slides into the slot in the rotor. At operational speeds, the rotating blades may vibrate at natural or resonant frequencies that create stresses in the roots, adaptors, and/or slots that may lead to accelerated material fatigue. Therefore, various damper systems have been developed to damp vibrations between adjacent rotating blades. In some damper systems, a metal rod or damper is inserted between adjacent platforms, adjacent adaptors, and/or between the root and the adaptor or the rotor. At operational speeds, the weight of the damper seats the damper against the complementary surfaces to exert force against the surfaces and damp vibrations.

Higher operating temperatures generally result in improved thermodynamic efficiency and/or increased power output. Higher operating temperatures also lead to increased erosion, creep, and low cycle fatigue of various components along the hot gas path. As a result, ceramic material composite (CMC) materials are increasingly being incorporated into components exposed to the higher temperatures associated with the hot gas path. As CMC materials become incorporated into the airfoils, platforms, and/or roots of rotating blades, the ceramic surfaces of the rotating blades more readily abrade the conventional metallic dampers. The increased abrasion of the metallic dampers may create additional foreign object debris along the hot gas path and/or reduce the mass of the dampers, reducing the damping force created by the dampers. Therefore, an improved system for damping vibrations in a turbine would be useful.

BRIEF DESCRIPTION OF THE INVENTION

Aspects and advantages of the invention are set forth below in the following description, or may be obvious from the description, or may be learned through practice of the invention.

One embodiment of the present invention is a system for damping vibrations in a turbine. The system includes a first rotating blade having a first ceramic airfoil, a first ceramic platform connected to the first ceramic airfoil, and a first root connected to the first ceramic platform. A second rotating blade adjacent to the first rotating blade includes a second ceramic airfoil, a second ceramic platform connected to the second ceramic airfoil, and a second root connected to the second ceramic platform. A non-metallic platform damper has a first position in simultaneous contact with the first and second ceramic platforms.

Another embodiment of the present invention is a system for damping vibrations in a turbine that includes a rotating blade having a ceramic airfoil and a ceramic root connected to the ceramic airfoil. An adaptor is configured to connect the rotating blade to a rotor wheel, and a non-metallic root damper has a first position in simultaneous contact with the ceramic root and the adaptor.

In yet another embodiment, a system for damping vibrations in a turbine includes a first rotating blade having a first ceramic airfoil and a first ceramic root connected to the first ceramic airfoil. A second rotating blade adjacent to the first rotating blade includes a second ceramic airfoil and a second ceramic root connected to the second ceramic airfoil. A non-metallic root damper has a first position in simultaneous contact with the first and second ceramic roots.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
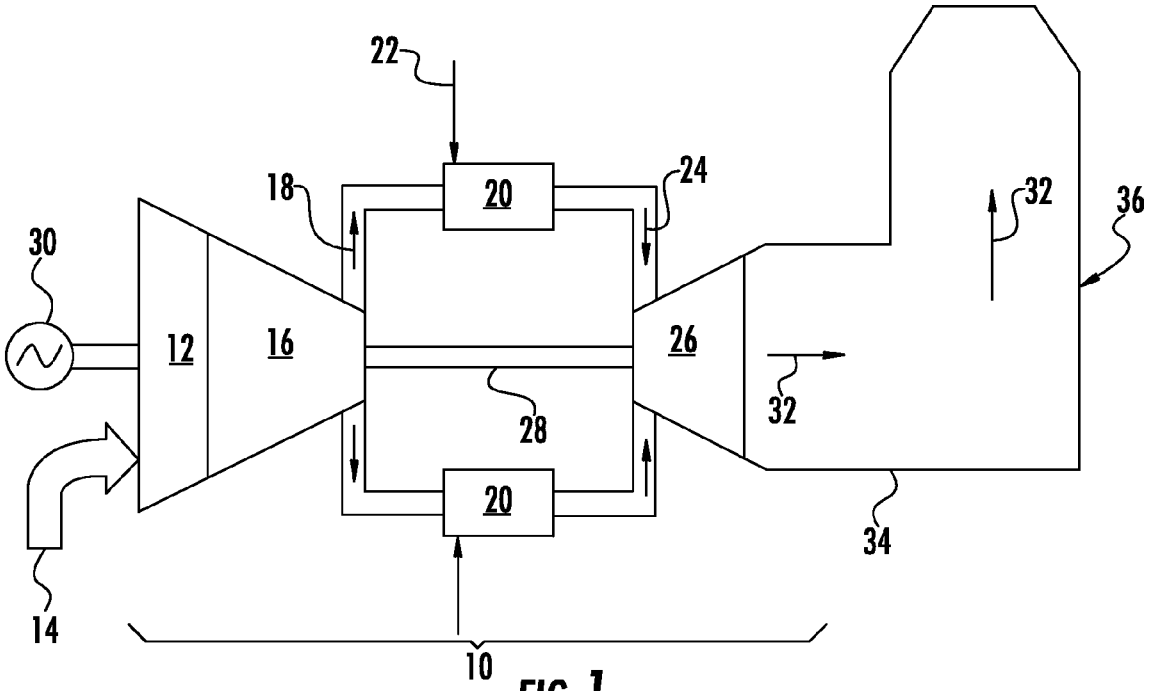
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system for damping vibrations in a turbine. The system generally includes one or more rotating blades having ceramic material composite (CMC) materials incorporated into various features of the rotating blades. For example, the rotating blades may include an airfoil, a platform, and/or a root, one or more of which may be manufactured from or coated with CMC materials. The system further includes a non-metallic damper having a shape, size, and/or position that places the damper in contact with one or more CMC features of the rotating blades to damp vibrations from the rotating blades. Although various exemplary embodiments of the present invention may be described in the context of a turbine incorporated into a gas turbine, one of ordinary skill in the art will readily appreciate that particular embodiments of the present invention are not limited to a turbine incorporated into a gas turbine unless specifically recited in the claims.

Referring now to the drawings, wherein identical numerals indicate the same elements throughout the figures, FIG. 1 provides a functional block diagram of an exemplary gas turbine 10 within the scope of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor 16, and the compressor 16 progressively imparts kinetic energy to the working fluid 14 to produce a compressed working fluid 18 at a highly energized state. The compressed working fluid 18 flows to one or more combustors 20 where it mixes with a fuel 22 before combusting to produce combustion gases 24 having a high temperature and pressure. The combustion gases 24 flow through a turbine 26 to produce work. For example, a shaft 28 may connect the turbine 26 to the compressor 16 so that rotation of the turbine 26 drives the compressor 16 to produce the compressed working fluid 18. Alternately or in addition, the shaft 28 may connect the turbine 26 to a generator 30 for producing electricity. Exhaust gases 32 from the turbine 26 flow through a turbine exhaust plenum 34 that may connect the turbine 26 to an exhaust stack 36 downstream from the turbine 26. The exhaust stack 36 may include, for example, a heat recovery steam generator (not shown) for cleaning and extracting additional heat from the exhaust gases 32 prior to release to the environment.

Figure 2:
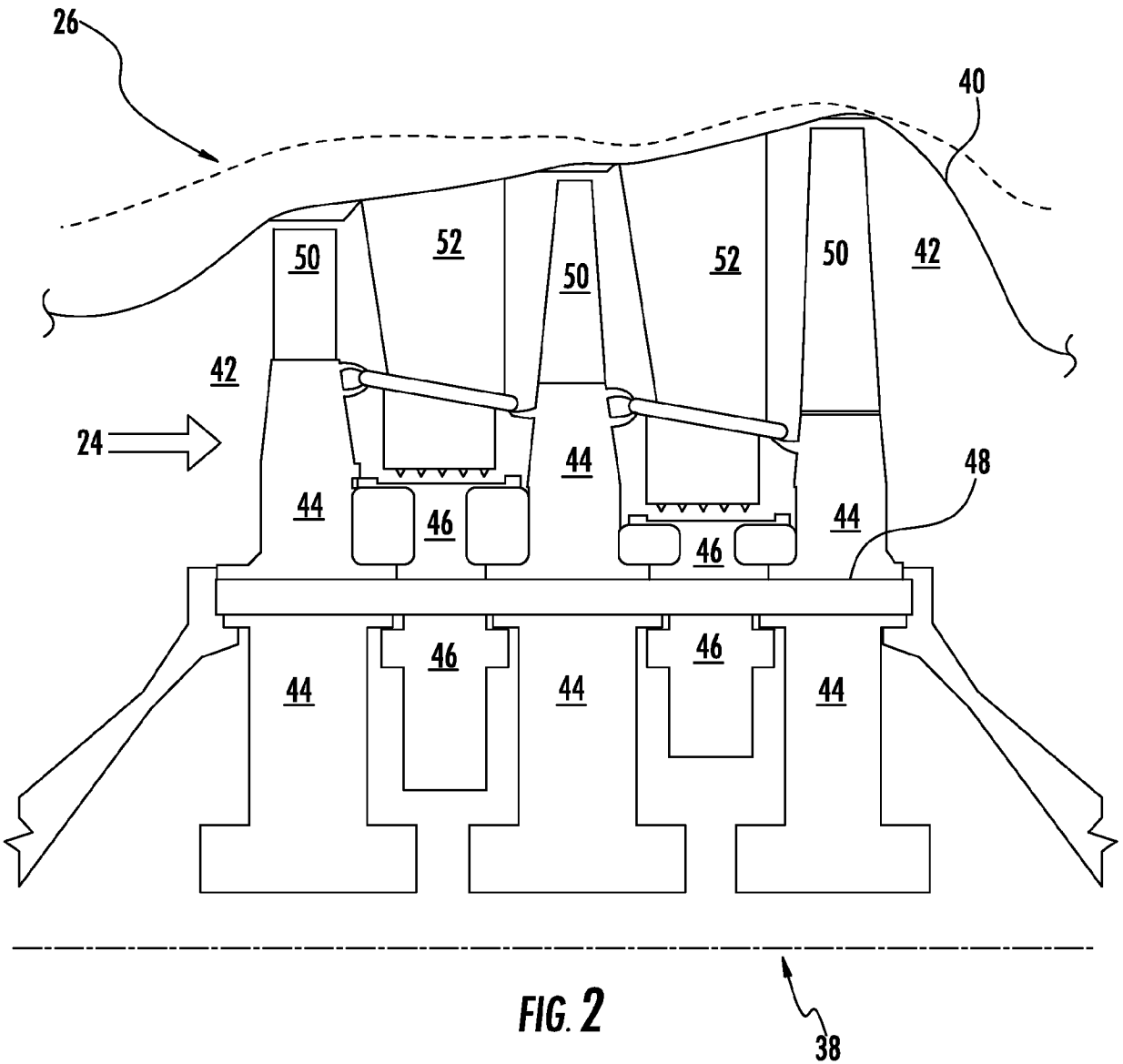
FIG. 2 is a simplified side cross-section view of a portion of an exemplary turbine that may incorporate various embodiments of the present invention.

FIG. 2 provides a simplified side cross-section view of a portion of the turbine 26 that may incorporate various embodiments of the present invention. As shown in FIG. 2, the turbine 26 generally includes a rotor 38 and a casing 40 that at least partially define a hot gas path 42 through the turbine 26. The rotor 38 may include alternating sections of rotor wheels 44 and rotor spacers 46 connected together by a bolt 48 to rotate in unison. The casing 40 circumferentially surrounds at least a portion of the rotor 38 to contain the combustion gases 24 or other compressed working fluid flowing through the hot gas path 42. The turbine 26 further includes alternating stages of rotating blades 50 and stationary vanes 52 circumferentially arranged inside the casing 40 and around the rotor 38 to extend radially between the rotor 38 and the casing 40. The rotating blades 50 are connected to the rotor wheels 44 using various means known in the art, as will be explained in more detail with respect to FIGS. 3-6. In contrast, the stationary vanes 52 may be peripherally arranged around the inside of the casing 40 opposite from the rotor spacers 46. The combustion gases 24 flow along the hot gas path 42 through the turbine 26 from left to right as shown in FIG. 2. As the combustion gases 24 pass over the first stage of rotating blades 50, the combustion gases 24 expand, causing the rotating blades 50, rotor wheels 44, rotor spacers 46, bolt 48, and rotor 38 to rotate. The combustion gases 24 then flow across the next stage of stationary vanes 52 which accelerate and redirect the combustion gases 24 to the next stage of rotating blades 50, and the process repeats for the following stages. In the exemplary embodiment shown in FIG. 2, the turbine 26 has two stages of stationary vanes 52 between three stages of rotating blades 50; however, one of ordinary skill in the art will readily appreciate that the number of stages of rotating blades 50 and stationary vanes 52 is not a limitation of the present invention unless specifically recited in the claims.

Figure 3:
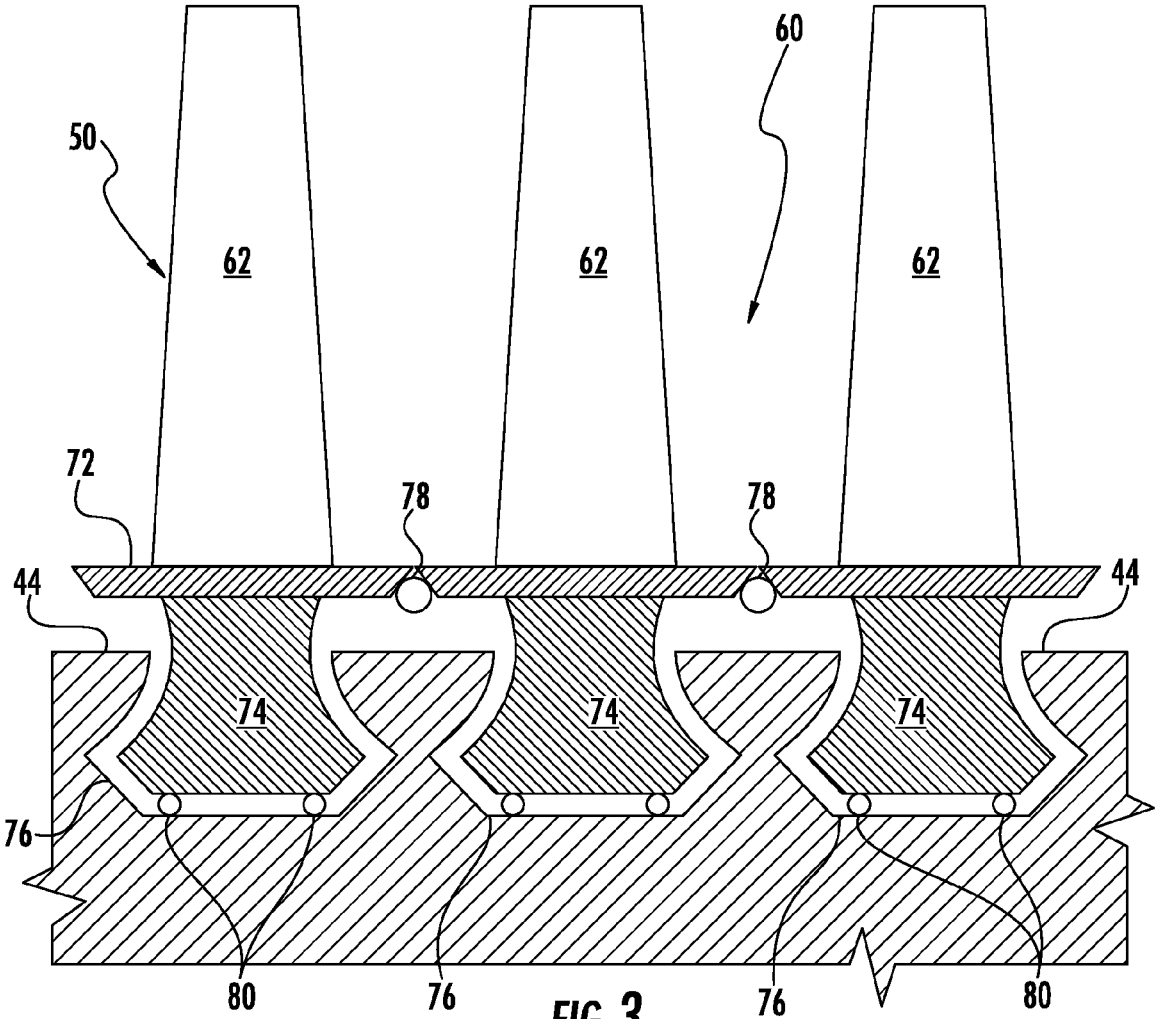
FIG. 3 is a simplified axial cross-section view of a system for damping vibrations in a turbine according to one embodiment of the present invention.
Figure 4:
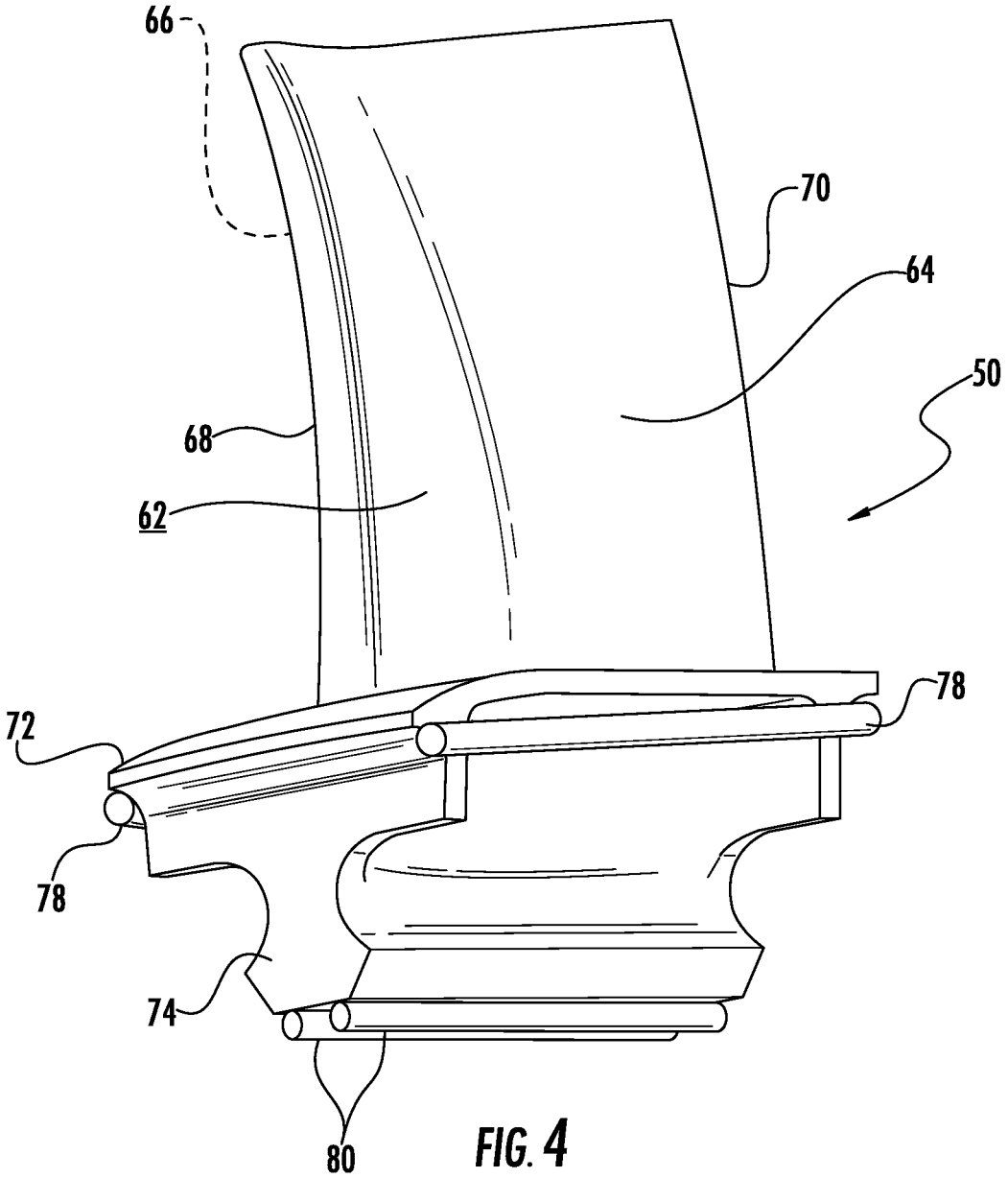
FIG. 4 is a perspective view of the system shown in FIG. 3.

FIG. 3 provides a simplified axial cross-section view of a system 60 for damping vibrations in the turbine 26 according to one embodiment of the present invention, and FIG. 4 provides a perspective view of the system 60 shown in FIG. 3 without the rotor wheel 44. The system 60 generally includes one or more rotating blades 50 circumferentially arranged around the rotor wheel 44, as previously described with respect to FIG. 2. As shown more clearly in FIGS. 3 and 4, each rotating blade 50 includes an airfoil 62, with a concave pressure side 64, a convex suction side 66, and leading and trailing edges 68, 70, as is known in the art. The airfoil 62 is connected to a platform 72 that at least partially defines a radially inward portion of the hot gas path 42. The platform 72 in turn connects to a root 74 that may slide into a slot 76 in the rotor wheel 44. In the particular embodiment shown in FIGS. 3 and 4, the root 74 and slot 76 have a complementary dovetail shape to hold the rotating blade 50 in place.

One or more sections of the rotating blades 50 may be formed from or coated with various ceramic matrix composite (CMC) materials such as silicon carbide and/or silicon oxide-based ceramic materials. For example, in the particular embodiment shown in FIGS. 3 and 4, the airfoil 62, the platform 72, and the root 74 are all formed from or coated with various CMC materials as is known in the art. In other particular embodiments, the platform 72 and/or the root 74 may be made from or coated with high alloy steel or other suitably heat resistant materials. Although the use of CMC materials in the rotating blades 50 may enhance the thermal and wear properties of the rotating blades 50, the CMC materials may also result in accelerated abrasion and wear against metallic dampers. As a result, the system 60 shown in FIGS. 3 and 4 includes one or more non-metallic dampers configured to contact with one or more sections of the rotating blades 50 made from or coated with CMC materials to damp vibrations associated with the rotating blades 50. The non-metallic dampers may be manufactured from one or more ceramic materials. For example, the non-metallic dampers may include zirconia, polycrystalline alumina, sapphire, silicon carbide, silicon nitride, or combinations thereof. In the case of silicon carbide, the ceramic material may include sintered alpha silicon carbide, reaction bonded silicon carbide, and/or melt infiltrated silicon carbide with a density of three and a durability approximately equal to polycrystalline alumina. As another example, hot iso-pressed silicon nitride with a density of three and a durability comparable to polycrystalline alumina or zirconia may provide a suitable non-metallic material for the dampers. As a result, the non-metallic dampers will have the desired heat properties along with superior wear resistance compared to conventional metallic dampers. Coatings on the non-metallic components might include a protective environmental barrier coating that may be composed of alkali-alumino-silicates such as BSAS (barium-strontium-alumino-silicate) or rare earth silicates such as yttrium-disilicate. Other ceramic coatings might be applied to the non-metallic components to enhance wear resistance or damping effectiveness.

In the particular embodiment shown in FIGS. 3 and 4, the system 60 includes one or more non-metallic platform dampers 78 and one or more non-metallic root dampers 80 that extend axially along the platforms 72 and roots 74, respectively. The non-metallic platform and root dampers 78, 80 shown in FIGS. 3 and 4 have a generally circular cross-section to enhance contact between the respective platforms 72 and roots 74 as the rotating blades 50 rotate. Specifically, as the rotating blades 50 turn, the non-metallic platform dampers 78 wedge between adjacent ceramic platforms 72 to damp vibrations between adjacent rotating blades 50. Similarly, the non-metallic root dampers 80 wedge between the ceramic roots 74 and the rotor wheel 44 in the dovetail slots 76 to damp vibrations from the rotating blades 50 to the rotor wheel 44.

Figure 5:
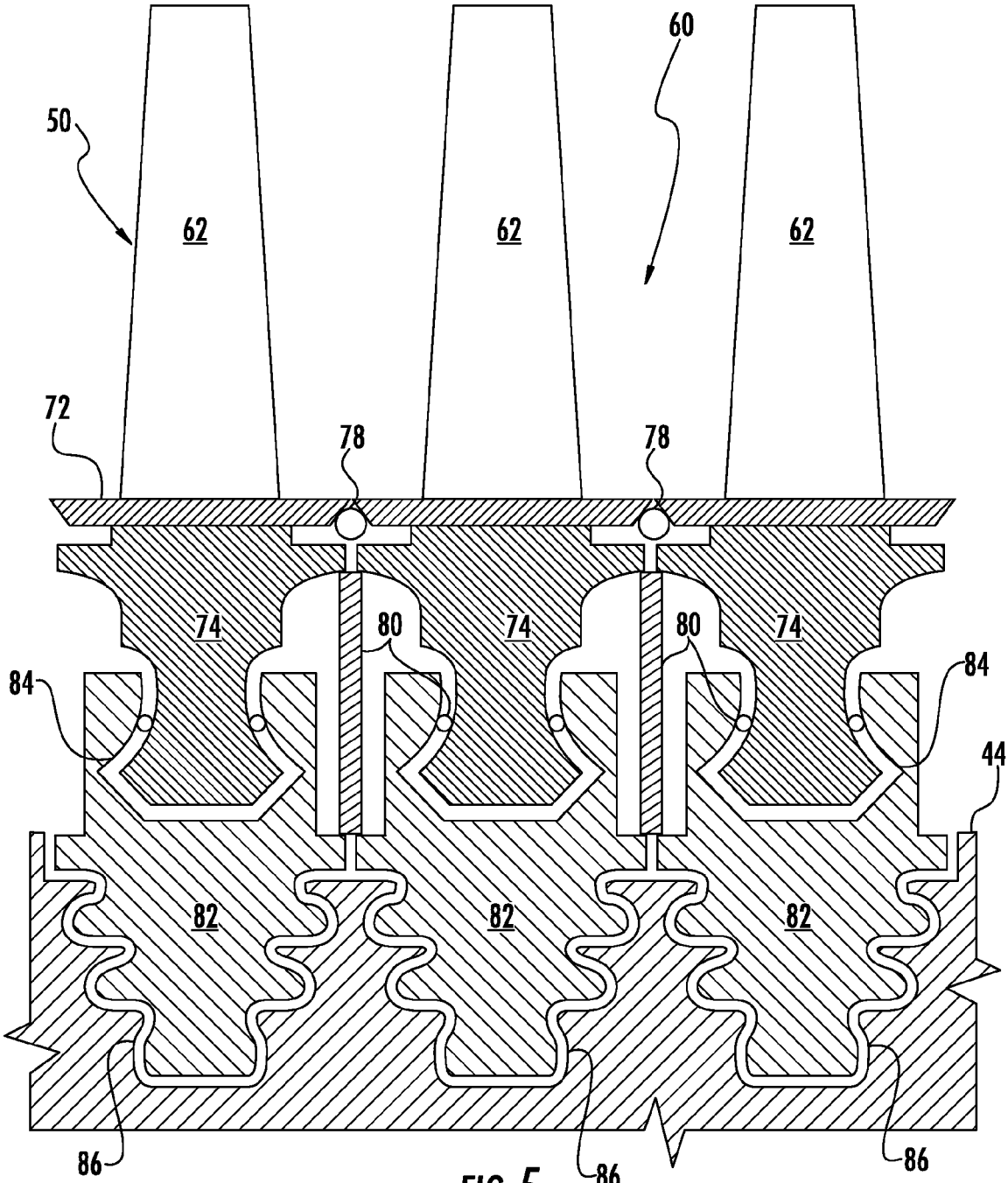
FIG. 5 is a simplified axial cross-section view of a system for damping vibrations in a turbine according to an alternate embodiment of the present invention.
Figure 6:
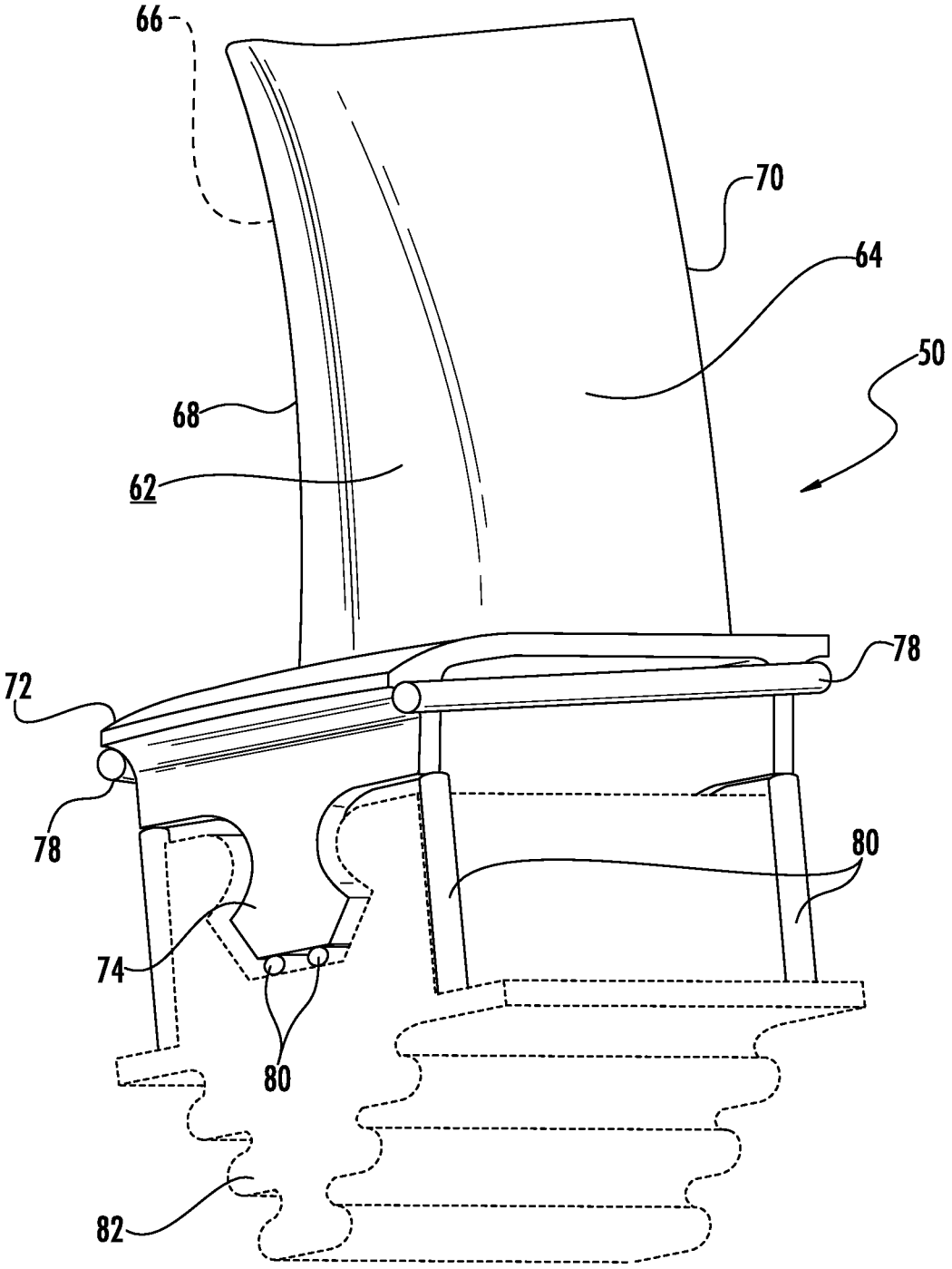
FIG. 6 is a perspective view of the system shown in FIG. 5.

FIG. 5 provides a simplified axial cross-section view of the system 60 for damping vibrations in the turbine 26 according to an alternate embodiment of the present invention, and FIG. 6 provides a perspective view of the system 60 shown in FIG. 5 without the rotor wheel 44. The system 60 again generally includes one or more rotating blades 50 circumferentially arranged around the rotor wheel 44, as previously described with respect to FIGS. 2-4. In this particular embodiment, the airfoil 62, the platform 72, and the root 74 are again made from or coated with CMC materials, and the system 60 further includes an adaptor 82 configured to connect the rotating blade 50 to the rotor wheel 44. For example, the root 74 that may slide into a dovetail slot 84 in the adaptor 82, and the adaptor 82 may in turn slide into a fir tree slot 86 in the rotor wheel 44. In this particular embodiment, the slot 84 in the adaptor 82 has a dovetail shape, while the slot 86 in the rotor wheel 44 has a fir tree shape. However, one of ordinary skill in the art will readily appreciate from the teachings herein that the slots 76, 84 may have various shapes that conform to the root 74 and adaptor 82, and the present invention is not limited to any particular shape of the slots 76, 84 unless specifically recited in the claims.

In the particular embodiment shown in FIGS. 5 and 6, the system 60 may again include one or more non-metallic dampers configured to contact with one or more sections of the rotating blades 50 made from or coated with CMC materials to damp vibrations associated with the rotating blades 50. For example, the system 60 may include one or more non-metallic platform dampers 78 that extend axially along the platforms 72, as previously described with respect to the embodiment shown in FIGS. 3 and 4. Alternately or in addition, the system 60 may include one or more non-metallic root dampers 80 that extend axially and/or radially in contact with adjacent roots 74 and/or with the root 74 and the adaptor 82. In this manner, the non-metallic root dampers 80 may damp vibrations between adjacent rotating blades 50 and/or between the root 74 and the adaptor 82.

Figure 7:
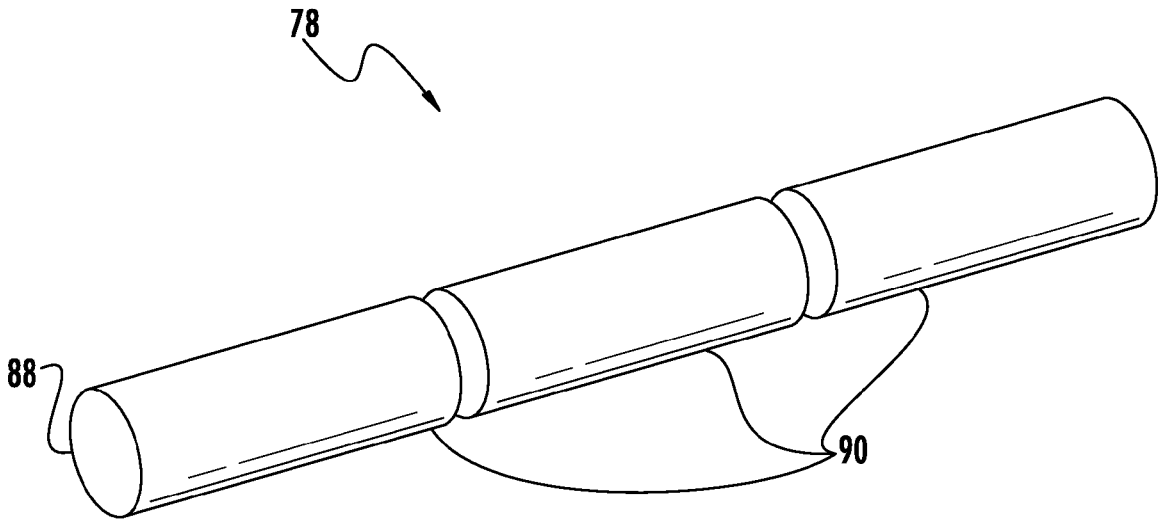
FIG. 7 is a perspective view of a non-metallic segmented damper having a circular cross-section within the scope of the present invention.

As will be described with respect to exemplary embodiments shown in FIGS. 7-10, the non-metallic dampers 78, 80 may include multiple sections, may be solid or hollow, and/or may have various cross-sections to enhance contact with one or more of the sections of the rotation blades 50 made from or coated with CMC materials. For example, FIG. 7 provides a perspective view of the non-metallic platform or root damper 78, 80 having a circular cross-section 88 and a plurality of segments 90. The circular cross-section 88 enables the damper 78, 80 to simultaneously contact multiple CMC material components having different shapes and/or orientations. In addition, each segment 90 individually and independently seats against the adjacent CMC material components to further isolate or damp vibrations in the turbine 26.

Figure 8:
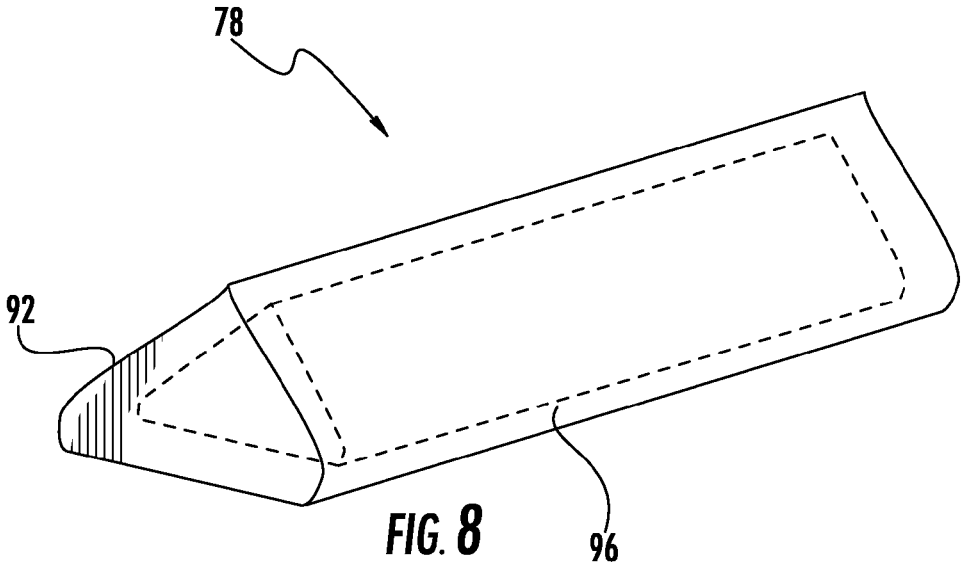
FIG. 8 is a perspective view of a non-metallic hollow damper having a triangular cross-section within the scope of the present invention.
Figure 9:
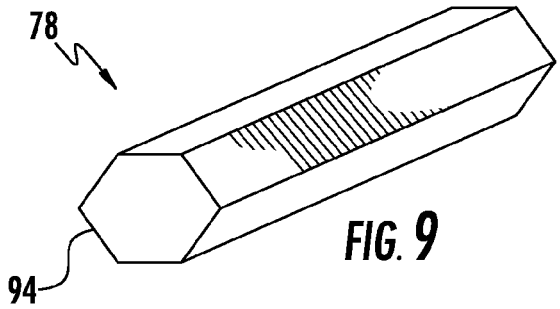
FIG. 9 is a perspective view of a non-metallic damper having a hexagonal cross-section within the scope of the present invention.

FIG. 8 provides a perspective view of a non-metallic platform or root damper 78, 80 having a triangular cross-section 92, and FIG. 9 provides a perspective view of a non-metallic platform or root damper 78, 80 having a hexagonal cross-section 94. The triangular or hexagonal cross-sections 92, 94 may enhance surface area contact between the damper 78, 80 and the adjacent CMC material component, depending on the particular size, shape and/or orientation of the adjacent CMC material component. In addition, the triangular damper 78, 80 shown in FIG. 8 may include one or more hollow portions 96 that may be used to adjust the mass of the damper 78, 80 to tune the location and/or the amount of damping between the damper 78, 80 and the adjacent CMC material component.

Figure 10:
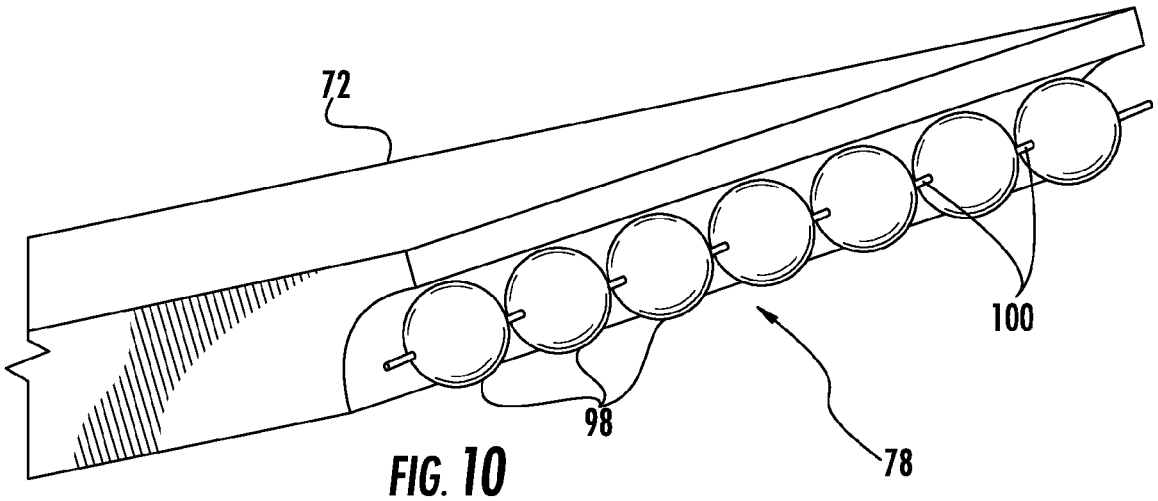
FIG. 10 is a perspective view of a non-metallic segmented damper having a plurality of spheres connected to one another within the scope of the present invention.

FIG. 10 provides a perspective view of another non-metallic platform or root damper 78, 80 having a plurality of segments 90. In this particular embodiment, the damper 78, 80 includes a plurality of spheres 98 connected to one another. For example, a tungsten wire 100 or other suitable material may connect to or extend through each sphere 98 to connect the spheres 98 into a segmented damper 78, 80. One of ordinary skill in the art will readily appreciate from the teachings herein that other geometric shapes for the dampers 78, 80 and segments 90 are within the scope of the present invention, and the particular geometric shape of the damper 78, 80 and/or segments 90 is not a limitation of the present invention unless specifically recited in the claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A system for damping vibrations in a turbine, comprising a. a first rotating blade having a first ceramic airfoil, a first ceramic platform connected to the first ceramic airfoil, and a first root connected to the first ceramic platform;

b. a second rotating blade adjacent to the first rotating blade, wherein the second rotating blade includes a second ceramic airfoil, a second ceramic platform connected to the second ceramic airfoil, and a second root connected to the second ceramic platform; and c. a non-metallic platform damper having a first position in simultaneous contact with the first and second ceramic platforms, the non-metallic platform damper comprising a plurality of spheres connected to one another.

2. The system as in claim 1, wherein the first and second roots are ceramic.

3. The system as in claim 2, further comprising a non-metallic root damper having a first position in simultaneous contact with the first and second roots.

4. The system as in claim 2, further comprising a non-metallic root damper having a first position in simultaneous contact with the first root and a rotor wheel.

5. The system as in claim 1, wherein the non-metallic platform damper comprises at least one of zirconia, polycrystalline alumina, sapphire, silicon carbide, or silicon nitride.

6. The system as in claim 1 wherein the non-metallic platform damper has at least one of a triangular or hexagonal cross-section.

7. The system as in claim 1, wherein the non-metallic platform damper comprises a plurality of segments.

8. The system as in claim 1, wherein the non-metallic platform damper is hollow.

9. A system for damping vibrations in a turbine, comprising:

a. a first rotating blade having a first ceramic airfoil and a first ceramic root connected to the first ceramic airfoil;

b. a first adaptor configured to connect the first rotating blade to a rotor wheel, the first adaptor having a slot for receipt of the first ceramic root, the slot and the first ceramic root having complementary shapes;

c. a second rotating blade adjacent to the first rotating blade, wherein the second rotating blade includes a second ceramic airfoil and a second ceramic root connected to the second ceramic airfoil;

d. a first non-metallic root damper extending axially within the slot in simultaneous contact with the first ceramic root and the first adaptor; and e. a second non-metallic root damper extending radially in simultaneous contact with the first ceramic root and the second ceramic root.

10. The system as in claim 9, wherein the first non-metallic root damper comprises at least one of zirconia, polycrystalline alumina, sapphire, silicon carbide, or silicon nitride.

11. The system as in claim 9, wherein the first non-metallic root damper has at least one of a triangular or hexagonal cross-section.

12. The system as in claim 9, wherein the first non-metallic, root damper comprises a plurality of spheres connected to one another.

13. The system as in claim 9, wherein the first non-metallic root damper comprises a plurality of segments.

14. The system as in claim 9, wherein the first non-metallic, root damper is hollow.

15. The system as in claim 9, further comprising a second adaptor configured to connect the second rotating blade to the rotor wheel, wherein the second non-metallic root damper extends radially in simultaneous contact with the first adaptor and the second adaptor.

16. A system for damping vibrations in a turbine, comprising:

a. a first rotating blade having a first ceramic airfoil and a first ceramic root connected to the first ceramic airfoil, the first ceramic root received within a first slot of a rotor wheel, the first slot and the first ceramic root having complementary shapes;

b. a second rotating blade adjacent to the first rotating blade, wherein the second rotating blade includes a second ceramic airfoil and a second ceramic root connected to the second ceramic airfoil; and c. a non-metallic root damper extending axially in the first slot in simultaneous contact with the first ceramic root and the rotor wheel such that a gap is formed between the first ceramic root and the rotor wheel.

17. The system as in claim 16, wherein the non-metallic root damper comprises at least one of zirconia, polycrystalline alumina, sapphire, silicon carbide, or silicon nitride.

18. The system as in claim 16, wherein the non-metallic root damper has at least one of a triangular or hexagonal cross-section.

19. The system as in claim 16, wherein the non-metallic root damper comprises a plurality of spheres connected to one another.

20. The system as in claim 16, wherein the non-metallic root damper comprises a plurality of segments.

* * * * *